United States Patent [19]

Cheney

[11] 3,966,022

[45] June 29, 1976

[54] WHEELCHAIR LIFT ASSEMBLY

[76] Inventor: Robert W. Cheney, 1533 N. 122nd St., Wauwatosa, Wis. 53213

[22] Filed: Oct. 15, 1974

[21] Appl. No.: 515,001

[52] U.S. Cl. ..... 187/12; 187/19

[51] Int. Cl.[2] ..... B66B 9/08

[58] Field of Search ..... 187/10–14, 187/16, 19, , 1 R; 214/100; 182/103

[56] References Cited

UNITED STATES PATENTS

| | | | |
|---|---|---|---|
| 774,348 | 11/1904 | Campbell | 187/19 X |
| 1,768,650 | 7/1930 | Wood | 187/12 |
| 2,212,388 | 8/1940 | Cheney | 187/12 |
| 2,856,027 | 10/1958 | Schryver | 187/12 |
| 2,888,099 | 5/1959 | Hoffmann | 187/12 |
| 2,950,948 | 8/1960 | Hardigan | 187/12 |
| 3,344,885 | 10/1967 | Rasmussen | 182/103 X |

*Primary Examiner*—Evon C. Blunk
*Assistant Examiner*—James L. Rowland
*Attorney, Agent, or Firm*—Michael, Best & Friedrich

[57] ABSTRACT

A wheelchair lift having a horizontally disposed wheelchair supporting platform and a vertically disposed frame member positioned adjacent to one of the walls of the stairwell. The frame member is connected to a guide rail mounted on said side wall via a sub-frame which is rotatably fixed to the frame member and which is provided with rollers for engagement with the guide rail. The frame member also including vertically and horizontally adjustable drive and idler pinions, the adjustment of the pinions and the rotatable adjustment of the sub-frame permitting use of the wheelchair lift in stairwells of varying inclinations. Also, the frame member being symmetrical in the vertical plane to thereby permit the wheelchair lift assembly to be used with a left hand as well as a right hand guide rail.

7 Claims, 8 Drawing Figures

WHEELCHAIR LIFT ASSEMBLY

BACKGROUND OF THE INVENTION

The invention relates to wheelchair lift assemblies which are intended to be installed in stairwells and to adjustment means for rendering the wheelchair lift adaptable for stairwells of varying inclinations as well as adjustable for use with a right hand as well as a left hand guide and drive rail assembly.

SUMMARY OF THE INVENTION

The adjustment feature of the wheelchair lift embodying the present invention resides in the provision of a flat generally disc shaped sub-frame having an arcuate portion which carries the guide roller assemblies. The sub-frame is positioned vertically and thus does not occupy significant transverse space, and because it is rotatably mounted around its horizontal center axis, it can be readily and easily fixed to the frame member at any one of its adjusted positions.

The wheelchair lift is also provided with adjustably mounted drive and idler pinions which can be fixed to the frame member in any of their adjusted positions and to thereby permit engagement with a rack which is parallel to the path of travel of the guide rollers.

The frame member is symmetrical in the vertical plane and the components of the wheelchair lift assembly are attachable to either side of the frame members to thereby render the assembly adaptable for left hand as well as right hand guide and drive channels.

THE DRAWINGS

GENERAL DESCRIPTION

Figure 7:
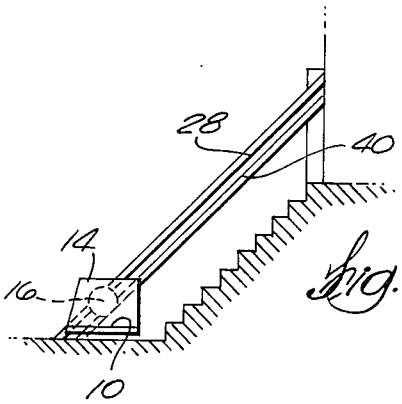
FIGS. 7 and 8 are schematic side views of the wheelchair lift illustrating its use on staircases of two different inclinations.
Figure 8:
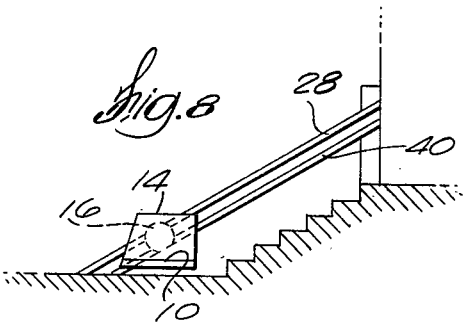
Figures 2, 6:
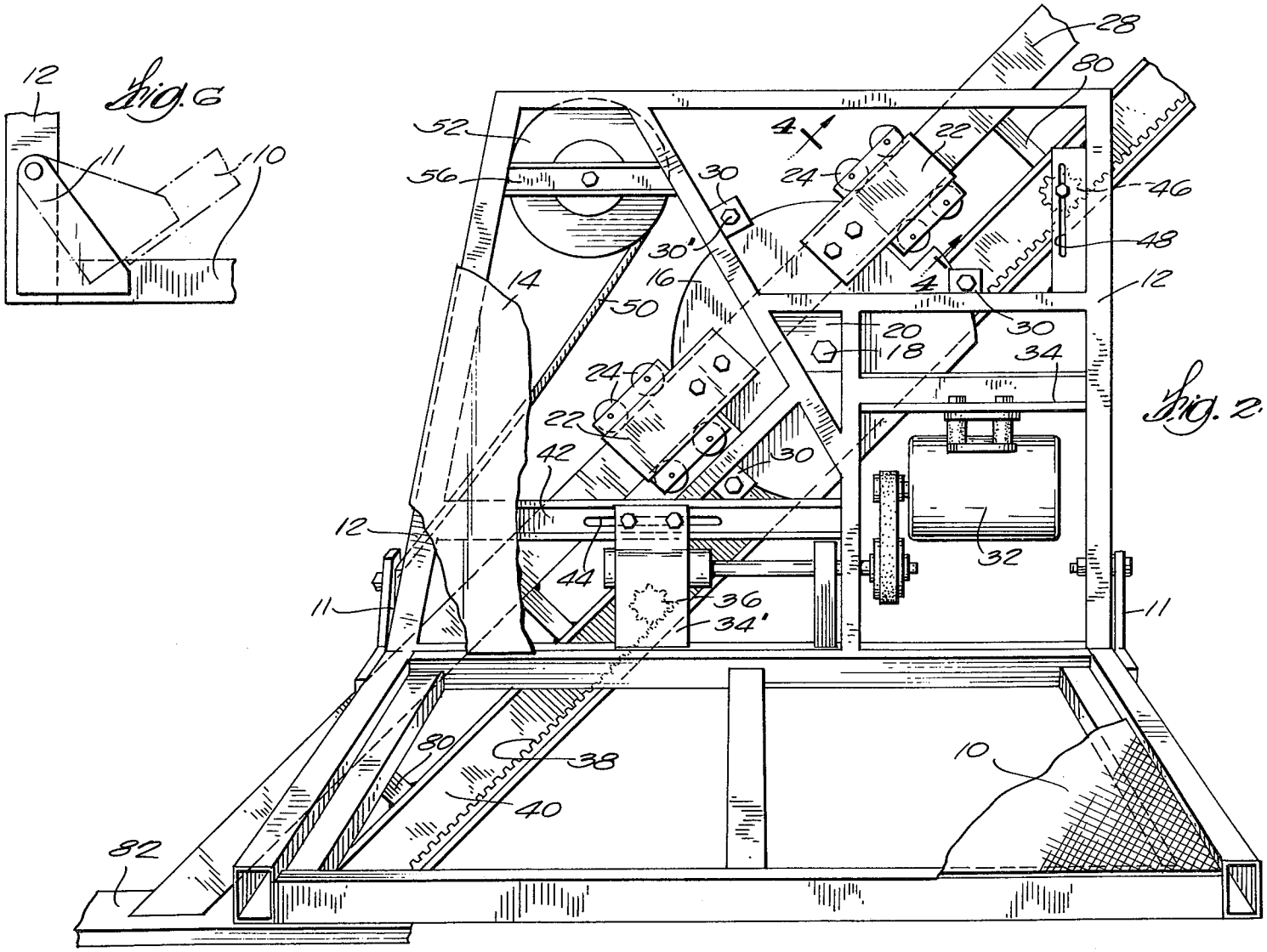
FIG. 2 is a perspective frontal side view of the wheelchair lift shown in FIG. 1 with portions broken away for the sake of clarity.
FIG. 6 is a side view of the hinged mechanism which connects the platform to the frame.

The wheelchair lift has a wheelchair support platform 10 which is fixed, via hinges 11, see FIG. 6, to a frame member 12 which is enclosed at its front, top and sides by a housing 14. Because the platform 10 must support a wheelchair, it must, of course, always remain horizontal irrespective of the degree of inclination of the particular stairwell in which the lift is installed, see FIGS. 7 and 8.

Figure 4:
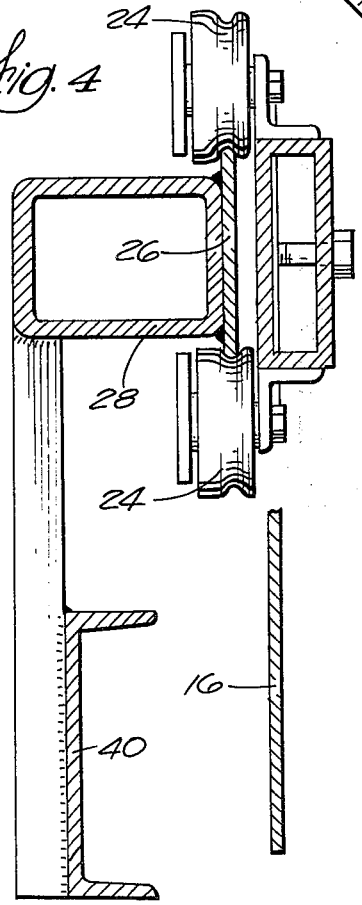
FIG. 4 is a cross-sectional view taken on line 4—4 of FIG. 2.

A generally disc shaped sub-frame member 16 having an arcuate portion is rotatably fixed to the frame 12 by a bolt 18 located at a central point relative to the arcuate portion of the sub-frame and projecting through a plate 20 of the frame 12. The sub-frame 16 carries two guide wheel support brackets 22 which in turn are provided with oppositely positioned pairs of grooved guide rollers 24, as best shown in FIGS. 2 and 4. The guide rollers are designed to engage the top and bottom edges of a flange 26 of a guide channel 28 as best shown in FIG. 4.

During installation of the wheelchair lift, the sub-frame 16 can be rotated around the bolt 18 to thereby place the support bracket 22 at an angle equal to the inclination of the stair well.

After the sub-frame 16 has been rotated to provide the proper angle of inclination of the guide rollers, arcuate portion of the the sub-frame is peripherally clamped to the frame member 12 by three clamps 30. The clamps are comprised of oppositely positioned tabs, the tabs extending on opposite sides of the sub-frame 16 and the tabs being pressed in engagement with the sub-frame upon tighening of bolts 30', and one of the tabs being fixed to the frame 12.

An electric motor 32 is fixed to a horizontally extending brace 34 of the frame 12 and is operably connected to a reduction gear box 34' via a pulley drive as shown in FIG. 2. The gear box is connected to a drive pinion 36 which engages a rack 38 of a drive channel 40. The gear box is fixed to a horizontally extending brace 42 of the frame 12 via a slot 44 as shown in FIG. 2. A guide pinion 46 is fixed via a vertically extending slot connection 48 to the frame 12.

Upon installation of the wheelchair lift, the gear box 34 and its pinion 36 and the pinion 46 are adjusted within the respectively horizontally and vertically extending slots so as to position the drive pinion 36 and the guide pinion 46 at an inclination equal to the inclination of the stair well in which the wheelchair lift is to be installed. After such adjustment, both pinions are fixed within the slots.

Electrical power for the motor 32 is provided via a cord 50 contained on a spring biased reel 52 which is fixed to the cross member 56 of the frame 12.

Figure 3:
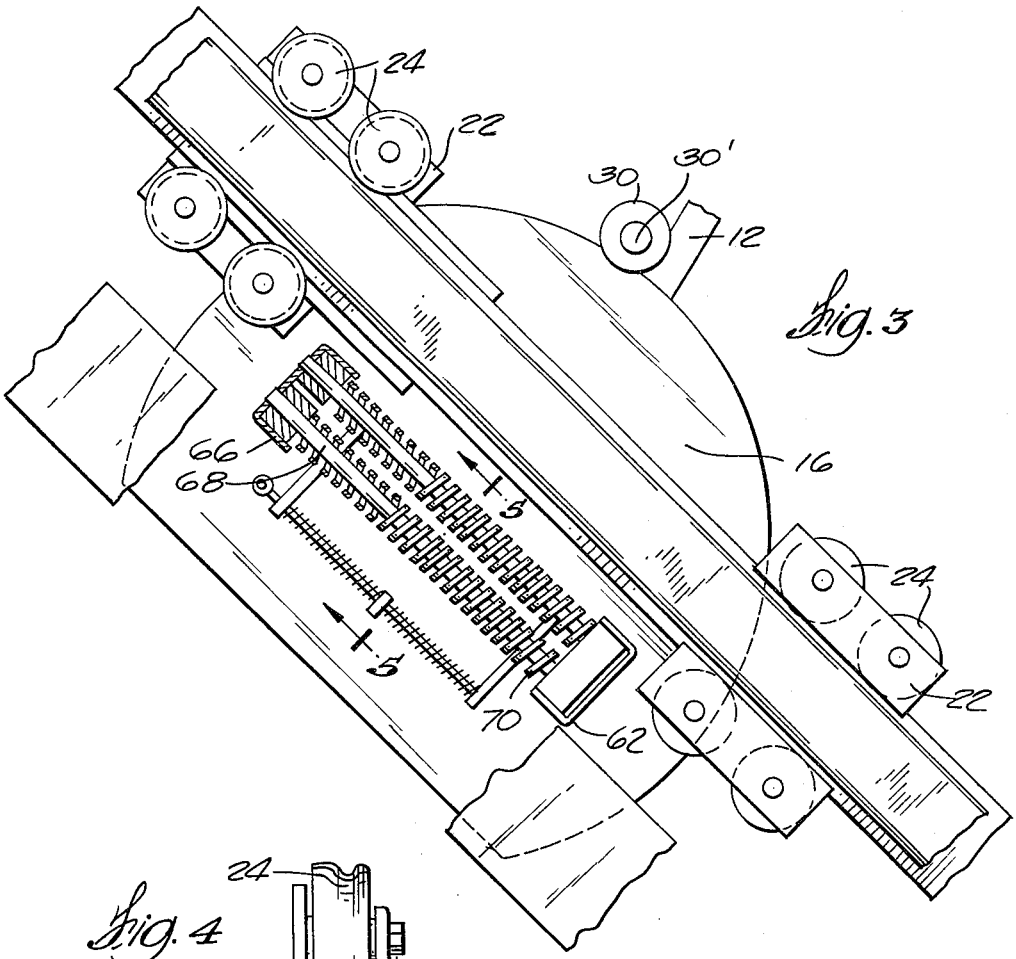
FIG. 3 is a partial back view of the wheelchair lift with portions broken away.
Figure 5:
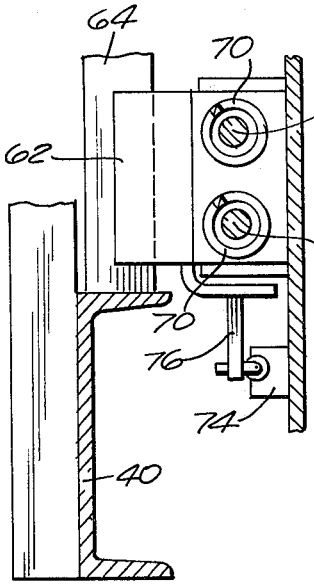
FIG. 5 is a cross-sectional view taken on line 5—5 of FIG. 3.

A spring loaded bumper is fixed to the rail side of the sub-frame 16, see FIGS. 3 and 5. The bumper member is provided at both of its ends with outwardly extending plates 62 which are adapted to engage stop members 64 provided at each end of the rail structure. Upon engagement of the plate 62 with the aforementioned stop members, the cap 66, to which the plate 62 is fixed, travels on rods 68 against the bias of compression springs 70 and thereby dampens the deceleration of the wheelchair lift. The rods 68 are fixed to the sub-frame 16. Limit switches 74 are provided at the top and bottom of the wheelchair lift travel and are engaged by a member 76 of the wheelchair lift frame to de-energize the motor 32.

As shown in the drawings, the entire wheelchair lift is supported by the box sectioned shaped guide rail which extends on one side of the stairwell. The drive channel 40 is parallel to the guide rail and is connected thereto by ribs 80. The guide and drive rail assembly is fixed at its bottom end to the floor by means of a supporting foot 82 which is either bolted to the floor or embeded therein and the top end of the guide and drive rail assembly is fixed to a vertically extending wall. If need be, the assembly might further be also fixed to the wall of the stairwell. However, for most applications, it is preferred not to rely upon the strength of the side wall for support. It is much easier to provide rigid and sufficiently strong support at the top and bottom of the rail assembly than to provide sufficiently strong wall supports.

When the wheelchair lift is not in use, its platform 10 may be pivoted upwardly to thereby provide ready access to the stairs.

Figure 1:
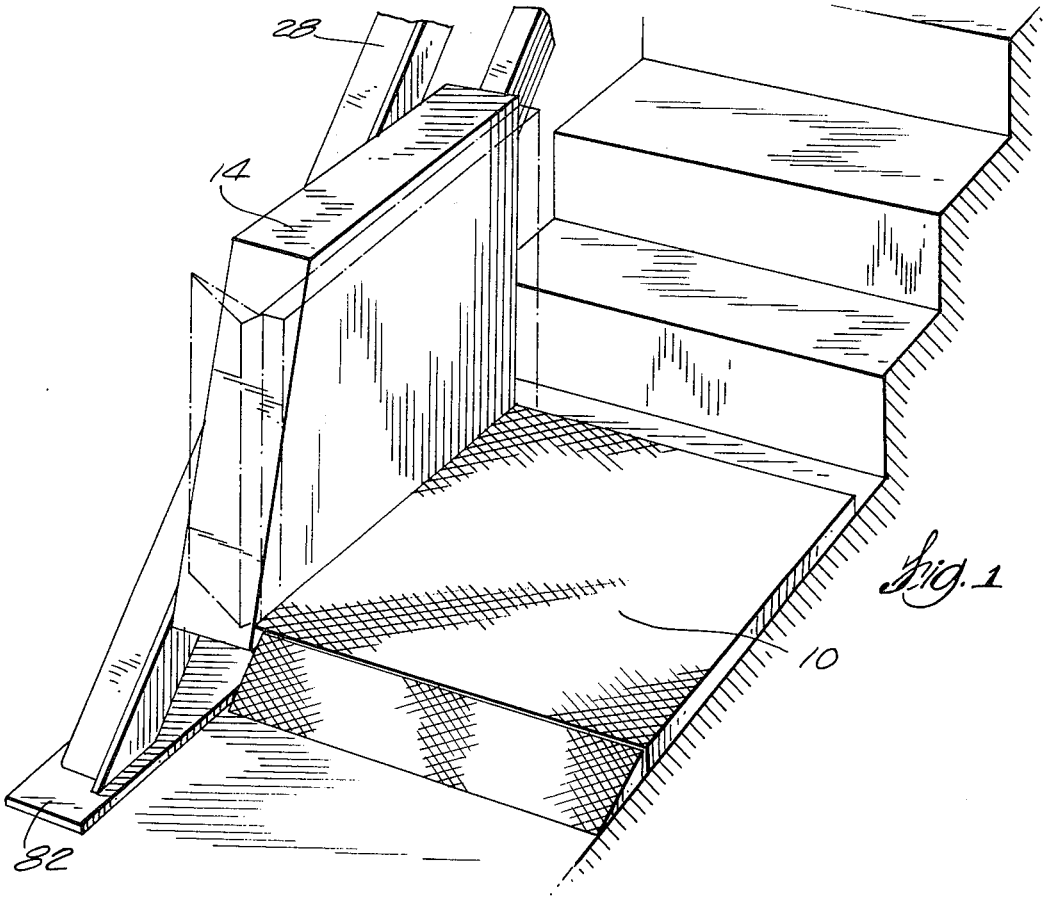
FIG. 1 is a perspective view of the wheelchair lift in a position at the bottom of the stairs.

As is readily apparent from the drawings, the operating components of the wheelchair lift are positioned on the rail side of the frame member and the platform is positioned on the stair side of the frame member 12. Because the frame member 12 and its components are symmetrical in the vertical plane, the illustrated wheelchair assembly is suitable for mounting on the left hand wall of the stairwell, as shown in FIG. 1, and is equally suited for mounting on the right hand wall. In the latter case, the sub-frame 16, the gear box 33, the reel 52 and the idler pinion 46 would have to be removed from their positions as shown in the illustrations and would merely have to be mounted on the other horizontal face of the frame member 12. Similarly, the platform 10 would have to be turned to 180° in the vertical plane and then be connected to the frame member 12 by hinges 11.

Various aspects of the invention are set forth in the following claims:

I claim:

1. A wheelchair lift assembly intended for installation in a stairwell and adapted to travel along a guide rail which is provided on one of the walls of the stairwell, the wheelchair lift comprising a generally vertically positioned frame member located adjacent to the wall having a guide rail, a generally horizontally extended wheelchair support platform fixed to said frame member and extending outwardly from the stair side of said frame member; a sub-frame member provided with roller means which is adapted to engage and travel along the guide rail; said sub-frame member being a generally vertically extending plate having an arcuate portion which is rotatably fixed to said frame member at a central point relative to said arcuate portion in order to permit adjustable rotation of said roller means in the vertical plane to thus maintain the support platform horizontal irrespective of the angle of inclination of the guide rail; means for fixing said sub-frame member to said frame member, said fixing means being positioned on said frame member in such a position as to be capable of engaging and fixing said arcuate portion of said sub-frame member to said frame member throughout the rotatable adjustment movement of said arcuate portion about said central point to thus fix said roller means in anyone of its adjusted positions; and power and guide means operable to transport the wheelchair lift along the guide rail.

2. A wheelchair assembly according to claim 1 wherein said roller means is comprised of two sets of roller assemblies which are fixed at different locations to said sub-frame member, and wherein each of said roller assemblies includes oppositely positioned grooved rollers which are adapted to engage vertically extending flanges of the guide rail to thus permit travel of said roller assemblies along the guide rail yet to prevent transverse movement of said roller assemblies in respect to the guide rail.

3. A wheelchair assembly according to claim 1 wherein said means for fixing said arcuate portion of said sub-frame member to said frame member are clamp means which are fixed to said frame member and which peripherally engage both sides of said arcuate portion of said sub-frame member and which are adapted to be tightened to thus fix said sub-frame member to said frame member.

4. A wheelchair assembly according to claim 3 wherein said power and guide means is comprised of a motor driven pinion and an idler pinion, both of which are fixed to said frame member, and a rack which is engaged by both of said pinions and which extends parallel to the guide rail.

5. A wheelchair assembly according to claim 4 including adjustment means for moving one of said pinions in a generally horizontal direction in the plane of said frame member and for moving the other of said pinions in a generally vertical direction in the plane of said frame member to thereby adjust the path of said pinions to a position parallel to the stairwell.

6. A wheelchair lift assembly according to claim 5 wherein said frame member is symmetrical in the vertical plane to thereby permit the attachment of said two pinions and of said sub-frame member on either side of said frame member and to thus render the wheelchair lift assembly suitable for use on either side of the stairwell.

7. A wheelchair lift assembly according to claim 3 wherein said sub-frame member is a generally disc-shaped plate.

* * * * *